US007546814B1

(12) United States Patent
Said

(10) Patent No.: US 7,546,814 B1
(45) Date of Patent: Jun. 16, 2009

(54) LAUNCH AND RECOVERY RAMP SYSTEM

(75) Inventor: Brian R. Said, Jupiter, FL (US)

(73) Assignee: Lockheed Martin Corp., Bethesda, MD (US)

( * ) Notice: Subject to any disclaimer, the term of this patent is extended or adjusted under 35 U.S.C. 154(b) by 162 days.

(21) Appl. No.: 11/733,784

(22) Filed: Apr. 11, 2007

Related U.S. Application Data

(60) Provisional application No. 60/791,210, filed on Apr. 12, 2006.

(51) Int. Cl.
*B63B 35/40* (2006.01)

(52) U.S. Cl. ..... 114/259; 114/362

(58) Field of Classification Search ..... 114/259, 114/45, 362; 405/1
See application file for complete search history.

(56) References Cited

U.S. PATENT DOCUMENTS 2,907,502 A * 10/1959 Lang ..... 222/557
3,734,046 A * 5/1973 Schmidt et al. ..... 114/259
RE29,591 E * 3/1978 Lloyd ..... 405/166
6,843,198 B1 * 1/2005 Witbeck ..... 114/258

* cited by examiner

*Primary Examiner*—Stephen Avila
(74) *Attorney, Agent, or Firm*—Wallace G. Walter

(57) ABSTRACT

A launch and recovery system for use by host vessel in launching and recovering a sub-ordinate vessel includes a ramp structure that is connected to a host vessel and movable so that at least its remote or distal end can be placed in the water, preferably at the stern of the host vessel. The ramp includes interior portions thereof that can be selectively flooded to control the buoyancy of the ramp at least its distal or remote end thereof to thus effect some measure of control of the inclination of the ramp. Additionally, one or more types of flow structures can be provided that effect control of the ramp as a function of water flow through and/or across the ramp. In one form, the flow structures can take the form of one or more thru-flow passages in the ramp so that water from the forward or leading side of the ramp can pass therethrough to the rearward or trailing side thereof. Various flow-control devices, such as moveable plates, baffles, or other members are controlled to increase or decrease flow rate through the flow passages to control the relative pitch or inclination of the ramp. In another form, the flow structures can take of the form of a movable fin or plane connected to the ramp structure that can be adjusted, either manually and/or as part of a control system, to control the relative pitch or inclination of the ramp.

16 Claims, 9 Drawing Sheets

LAUNCH AND RECOVERY RAMP SYSTEM

CROSS-REFERENCE TO RELATED PATENT APPLICATION

This application claims the benefit of commonly owned U.S. Provisional Patent Application 60/791,210 filed Apr. 12, 2006 by the applicant herein, the disclosure of which is incorporated herein by reference.

The subject matter of this application is related to that disclosed in commonly owned patent application Ser. No. 11/685,886 filed Mar. 14, 2007 by the inventor herein and entitled "Sub-Ordinate Vehicle Recovery/Launch System," the disclosure of which is incorporated herein by reference.

BACKGROUND OF THE INVENTION

The present invention relates to apparatus and method for the launching and the recovery of a sub-ordinate vehicle by host vehicle and, more particularly, to the launching and recovery of sub-ordinate seaborne surface and/or sub-surface vessels by a host seaborne surface and/or sub-surface vessel.

Various seaborne systems are known by which a host vessel can launch a sub-ordinate vessel and by which the host vessel can recover a sub-ordinate vessel. For example, remotely operated vessels, including submersible vessels, can be merely lifted from the deck of the host vessel by a crane of some type and placed on the surface of the water and, conversely, lifted from the surface of the water onto the deck of host vessel. In more sophisticated systems, a ramp is attached to the host vessel, typically at the bow or stern, and is lowered or otherwise extended so that the distal end of the ramp extends into the water. This latter system, which is best suited for tracked or wheeled sub-ordinate vessels or vehicles, allows the sub-ordinate vessel or vehicle to move down the ramp into the water to effect a launch, and, conversely, to move up the ramp onto the deck or into the interior of the host vessel to effect a recovery. In most cases, launch and recovery occurs while the host vessel is stopped or moving a relatively low forward speed.

While the prior ramp-type systems have functioned relatively satisfactorily for their intended purposes, the prior systems are not well-suited for sub-ordinate vessel recovery at higher speeds since the effects of surface and/or sub-surface currents, waves, and wind action on the two vehicles oftentimes can cause problems in positionally maintaining the alignment of the ramp relative to the sub-ordinate vessel to be launched or recovered. As can be appreciated, difficult-to-predict movements of the ramp relative to the sub-ordinate vessel during launch and/or recovery operations increases the probability of mishaps.

SUMMARY OF THE INVENTION

A launch and recovery system for use by a host vessel in launching and recovering a sub-ordinate vessel includes a ramp structure that is connected to a host vessel and movable so that at least its remote or distal end can be placed in the water, preferably at the stern of the host vessel. The ramp includes interior portions thereof that can be selectively flooded to control the buoyancy of the ramp at its distal or remote end thereof to thus effect some measure of control of the inclination of the ramp. Additionally, one or more types of flow structures can be provided that effect control of the ramp as a function of water flow through and/or across the ramp. In one form, the flow structures can take the form of one or more thru-flow passages in the ramp so that water from the forward or leading side of the ramp can pass therethrough to the rearward or trailing side thereof. Various flow-control devices, such as moveable plates, baffles, or other members are controlled to increase or decrease the flow rate through the flow passages to control the relative pitch or inclination of the ramp in response to or as a consequence of some function or functions, including, for example, the speed of the host vessel, wave action, swells, wind effects, host vessel heave, the distance separating the host vessel and the sub-ordinate vessel, and/or the like. In another form, the flow structures can take of the form of a movable fin or plane connected to the ramp structure that can be adjusted, either manually and/or as part of a control system, to control the relative pitch or inclination of the ramp in response to or as a consequence of some function or functions, including, for example, the speed of the host vessel, wave action, swells, wind effects, host vessel heave, the distance separating the host vessel and the sub-ordinate vessel, and/or the like.

The full scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
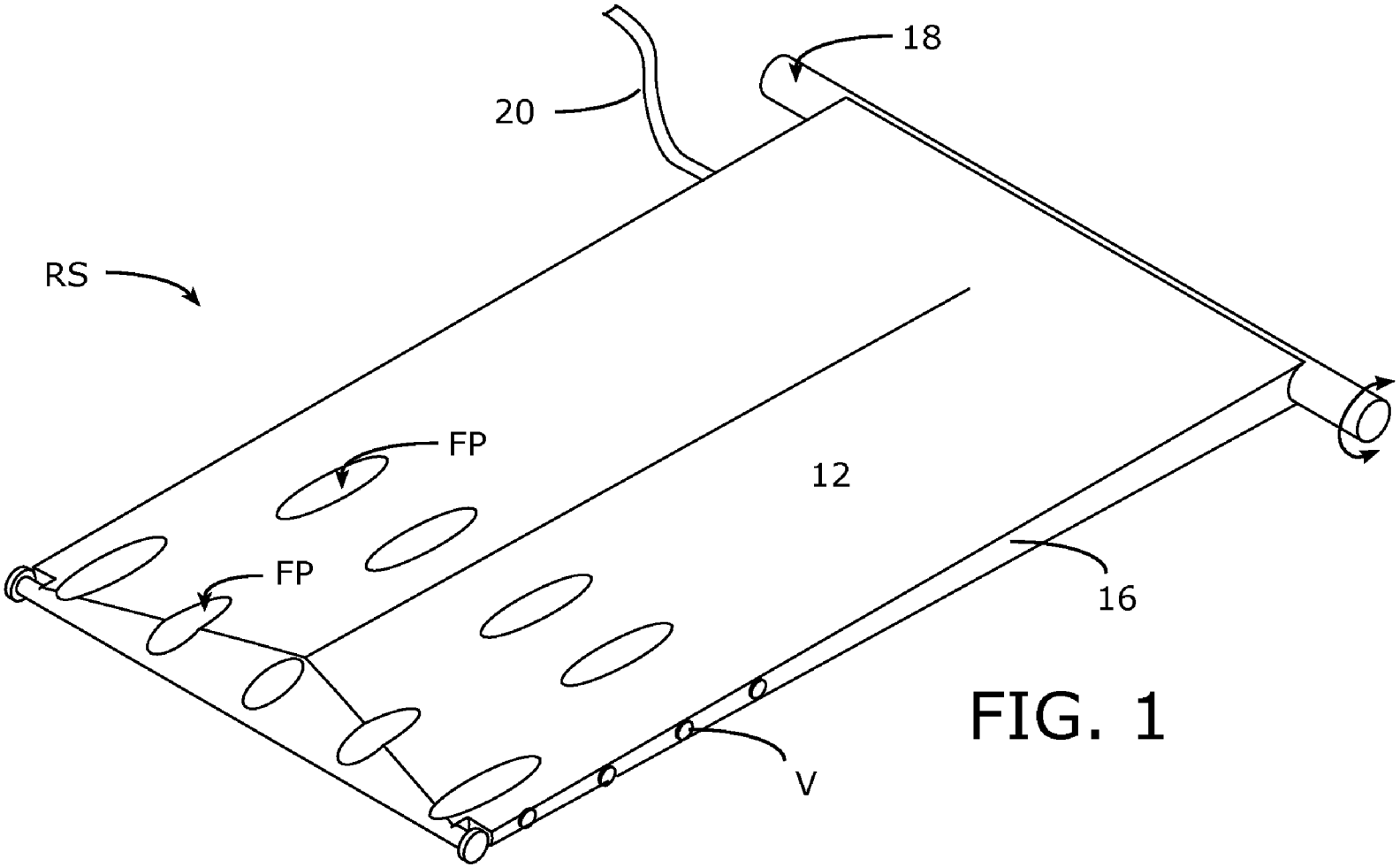
FIG. 1 is a perspective view of a ramp structure.

FIGS. 1-4 illustrate an example ramp structure in accordance with the present invention designated therein by the reference character RS. The ramp structure RS is typically formed as a weldment and includes a top side 12 (FIG. 1), a bottom side 14 (FIG. 2) and lateral sides 16. A shaft 18 or shaft-like equivalent is mounted at the forward end of the ramp structure 10 to allow a pivoting motion as explained below in relationship to FIG. 5; the shaft 18 is typically journalled in appropriate bearings or equivalent mounts on the host watercraft vessel. The top surface 12 need not be flat and can be formed from appropriately cut and shaped panels that are welded together. In a similar manner, the bottom surface 14 likewise need not be flat and can be formed from appropriately cut and shaped panels that are also welded together. The lateral sides 16 are welded to the top and bottom surfaces, 12 and 14, to form the structure shown. In general and except as described below, the ramp structure RS is a hollow, water-tight weldment.

Figure 6:
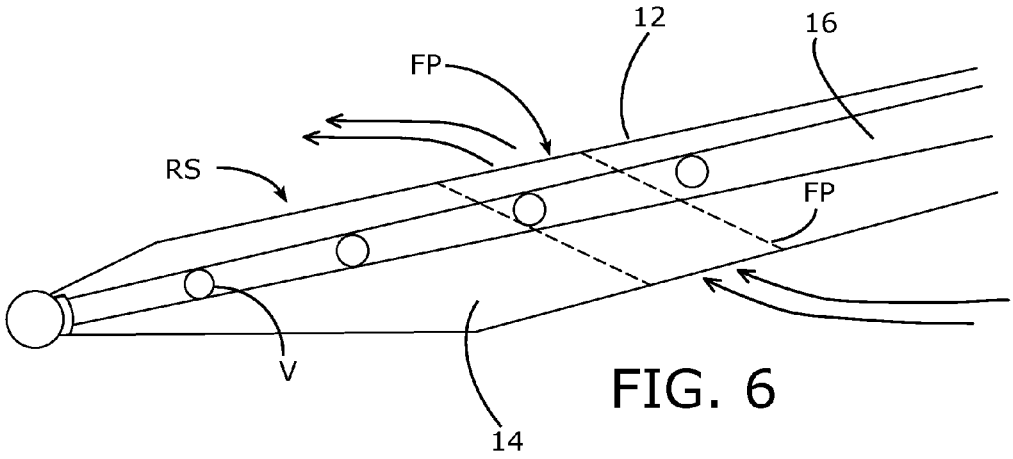
FIG. 6 illustrates the flow-thru feature of the ramp structure.

In the example embodiment shown, two rows of flow ports FP are provided in the ramp structure RS toward the trailing end thereof with the first row having five flow ports FP and the second row having four flow ports FP. As shown in FIG. 6, the opening on the top side 12 of a flow port FP connects with its respective opening on the bottom side 14 of the ramp structure RS. In the embodiment shown, each flow port FP is generally elliptical in shape with the openings on the top side 12 and the bottom side 14 connected by an appropriate passageway having wall surfaces that seals each flow port FP from the interior of the ramp structure RS. In general, the top side opening and the bottom side opening for each flow port FP are displaced or staggered from one another (as shown in FIG. 6) at some preferred angle. As explained below, the water flow rate through each flow port FP can be controlled to control the angular attitude of the ramp structure RS during launch and/or recovery operations.

Figure 2:
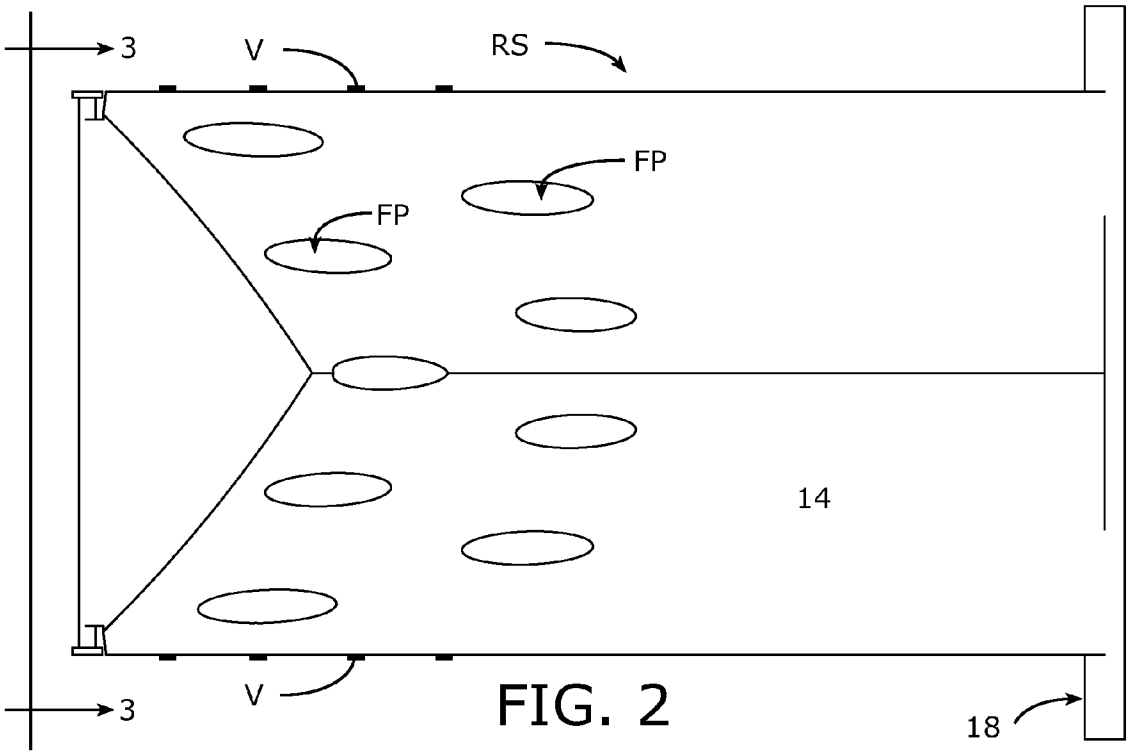
FIG. 2 is a top or plan view of the ramp structure shown in FIG. 1.
Figure 3:
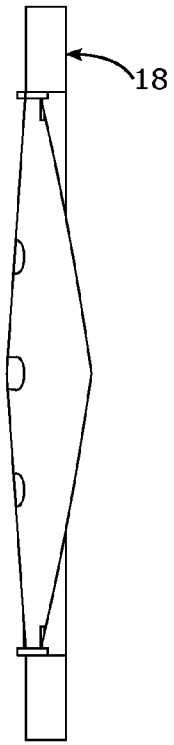
FIG. 3 is an end view of the ramp structure taken along line 3-3 of FIG. 2.

The particular configuration of flow ports FP shown in FIGS. 1 and 2 is exemplary only and, as can be appreciated, other flow port shapes (i.e., rectilinear, curvilinear), sizes, and configurations are possible.

Figure 4:
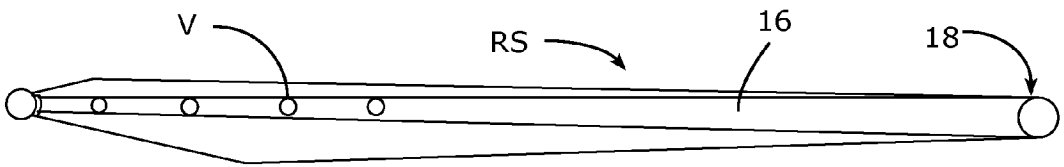
FIG. 4 is a side view of the ramp structure shown in FIG. 2.

As best shown in FIGS. 1 and 4, one or both lateral sides 16 include one or more vents or valves V that can be controlled to admit water into the interior of the ramp structure RS and conversely eject water from the interior of the ramp structure RS in response, for example, to a controlled flow of compressed air introduced into the interior of the ramp structure RS through an air line 20 (FIG. 1). The interior of the ramp structure RS is hollow and can be partly filled with water to control the buoyancy of the ramp structure RS as a way of controlling its attitude or angular relationship with the host vessel and, if desired, as a way controlling the damping characteristic or response of the ramp structure RS. The number and placement of the valves 16 is representative only and, in practice, the valves 16 can be placed in or on other parts of the ramp structure RS including at the aft or distal end thereof. The valve or valves V can controlled in any manner including by pneumatic, hydrualic, electrically, etc. In another form, the valves V can take the form of simple vents that allow partical flooding of an interior portion or portions of the ramp RS with the flow of pressurized air via air line 20 controlling the amount or level of flooding. The flow of pressurized air can be provided by the host vessel including the use of appropriate valving to control the flow or provide ON/OFF control thereof.

Figure 5:
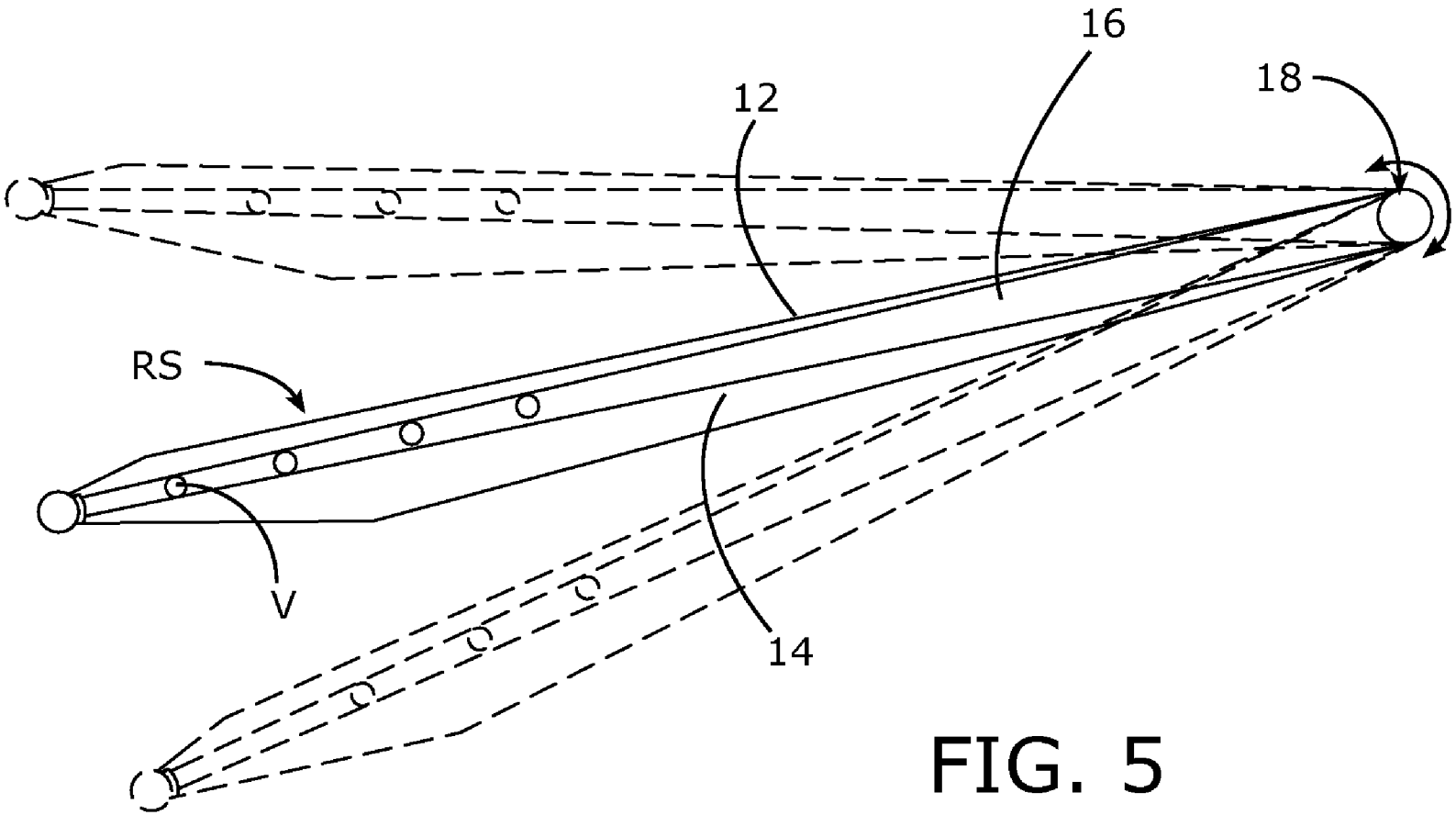
FIG. 5 illustrates an exemplary range of motion for the structure of FIGS. 1-4.

As represented in FIG. 5, the ramp structure RS is typically positioned at or near the stern of a host vessel with the shaft 18 appropriately journalled so that the ramp structure RS can move between various inclined positions relative to the horizontal. In general and as explained in the above-incorporated commonly owned U.S. Provisional Patent Application 60/782,274 filed Mar. 15, 2006 by the inventor herein, the attitude of the ramp structure RS is adjusted or changed during the launch operation or the recovery operation to accommodate the needs of the sub-ordinate vessel. As explained below in relationship to FIGS. 6-8, the attitude of the ramp structure can be adjusted in a variety of ways.

FIG. 6 illustrates the trailing end portion of the ramp structure RS with a flow port FP shown in dotted-line extending between the bottom side 14 and the top side 12. As the ramp structure RS moves in the water, some water will enter the flow port opening on the bottom side 14 of the ramp structure RS, flow through the passageway that defines the flow port FP, and exit the flow port FP through the opening thereof on the top side 12 of the ramp structure RS, as shown by the flow arrow in FIG. 6.

Figure 7A:
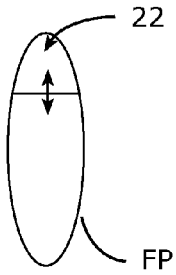
FIGS. 7*a*-7*b* illustrate one manner in which the thru-flow feature of the ramp structure is controlled.
Figure 7B:
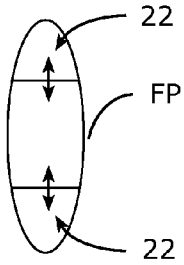
Figure 7C:
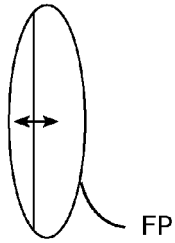
FIGS. 7*c*-7*d* illustrate another manner by which the thru-flow feature of the ramp structure is controlled.
Figure 7D:
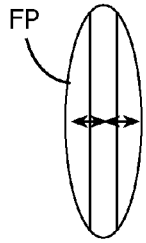
Figure 7E:
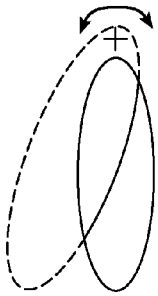
FIG. 7*e* illustrates yet another manner by which the thru-flow feature of the ramp structure is controlled.

As shown in FIGS. 7*a*-7*e*, one or more of the flow ports FP can be provided with restriction devices to control the flow therethrough. For example and as shown in FIG. 7*a*, a moveable plate 22 can be provided to reduce the flow cross-section through the flow port FP; if desired and as shown in FIG. 7*b*, a second plate 22 can be provided to cooperate with the first plate 22. While not shown in the figures, the plate 22 or plates 22 can be controlled by interconnected links to enlarge or decrease the flow cross-section in response to manual control, hydraulic (or pneumatic) cylinder control, electromagnetic actuators, or other suitable devices. As the plate 22 or plates 22 are adjusted to reduce the thru flow cross-section, the force on the ramp structure RS that tends to pivot the ramp structure RS toward the horizontal is increased and, conversely, as the plate 22 or plates 22 are adjusted to increase the thru-flow cross-section, the force on the ramp structure RS that tends to pivot the ramp structure RS toward the horizontal is decreased. As a variation of the structure shown in FIGS. 7*a* and 7*b*, the flow controlling plates can be mounted along the long axis of the flow port FP and moved as desired, as shown in FIGS. 7*c* and 7*d*. A further variant is shown in FIG. 7*e* in which one or more rotatably mounted plates (unnumbered) are selectively rotated about a pivot axis to control the thru-flow cross-section of the flow port FP.

The flow control arrangements of FIGS. 7*a*-7*e* are merely exemplary and other flow control arrangements are suitable, including, for example, plural shutter plates or vanes that rotate between open and closed positions and expanding/contracting "iris" type arrangements as well as various types of valving.

Figure 8:
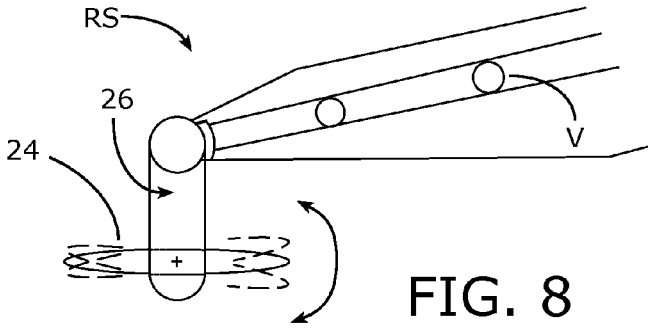
FIG. 8 illustrates an exemplary control plane at the end of the ramp structure.

FIG. 8 illustrates another way in which the attitude of the ramp structure RS can be controlled. As shown, a flow plane 24 is attached, for example, to the trailing end of the ramp structure RS by a suitable bracket 26. The attitude of the flow plane 24 is controlled manually, hydraulically, pneumatically, and/or electromechanically to apply a rising force or a descending force to the remote end of the ramp structure RS to cause an attitude adjustment thereof.

As explained above, the valving V allows water to be introduced into or ejected from the interior of the ramp structure to the change the buoyancy thereof, to change the damping characteristic thereof, and similarly provide a mechanism by which the angular relationship or attitude of the ramp structure RS can be controlled.

While a plurality of control techniques have been disclosed and can be used in combination with one another, the use of only one or or the use of less than all df the disclosed techniques is also contemplated. For example, the use of flooding to control the angular relationship or attitude of the ramp structure RS is better suited for those situations in the host vessel is stopped or moving at a relatively slow speed while the use of the controlled cross-section flow ports FP and/or controllable plane (FIG. 8) is better suited for those situation in which the host vessel is underway at some forward speed.

Figure 9:
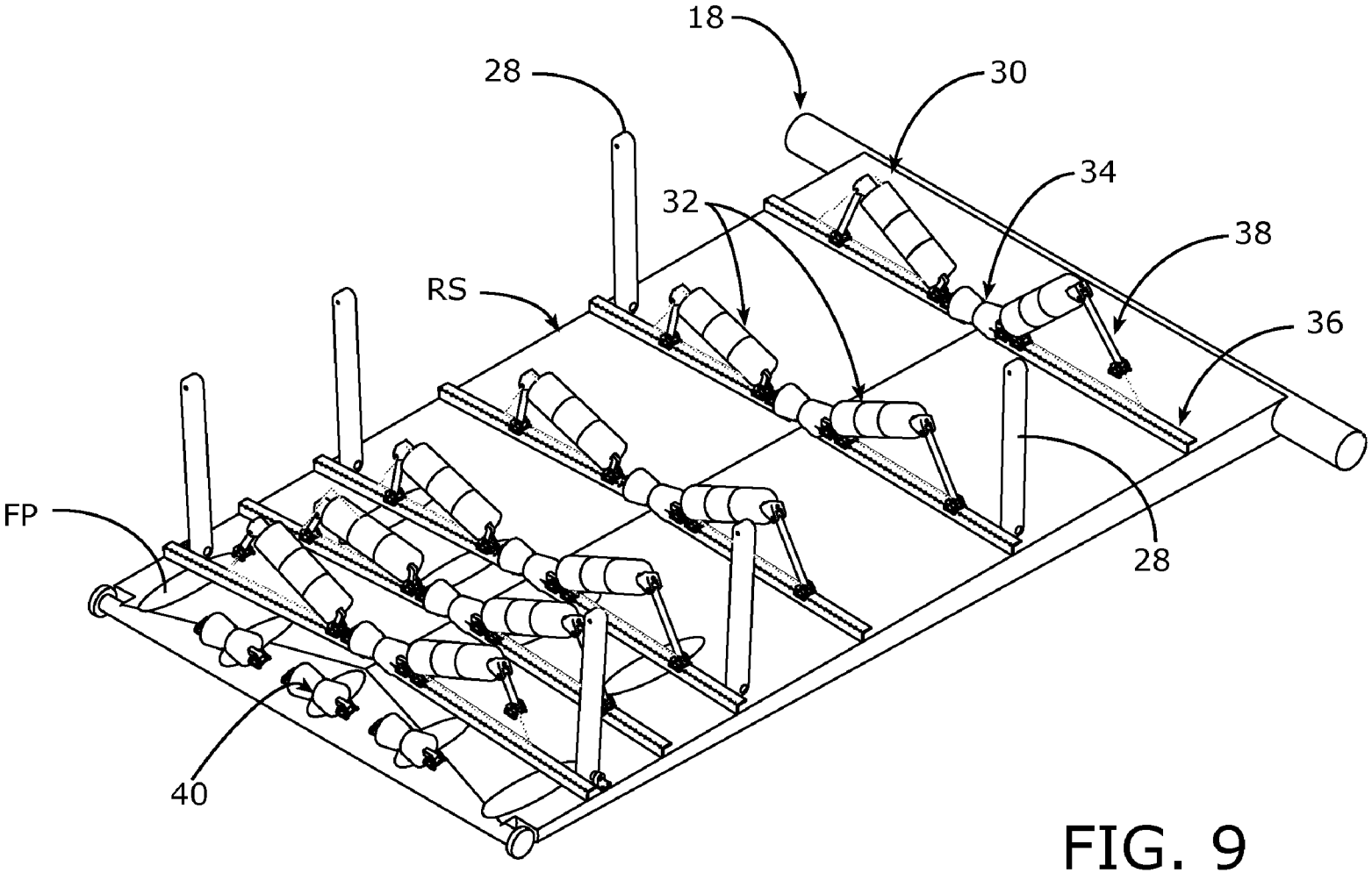
FIG. 9 is a perspective view of a ramp structure of FIG. 1 equipped with roller structures for receiving the sub-ordinate vessel.
Figure 10:
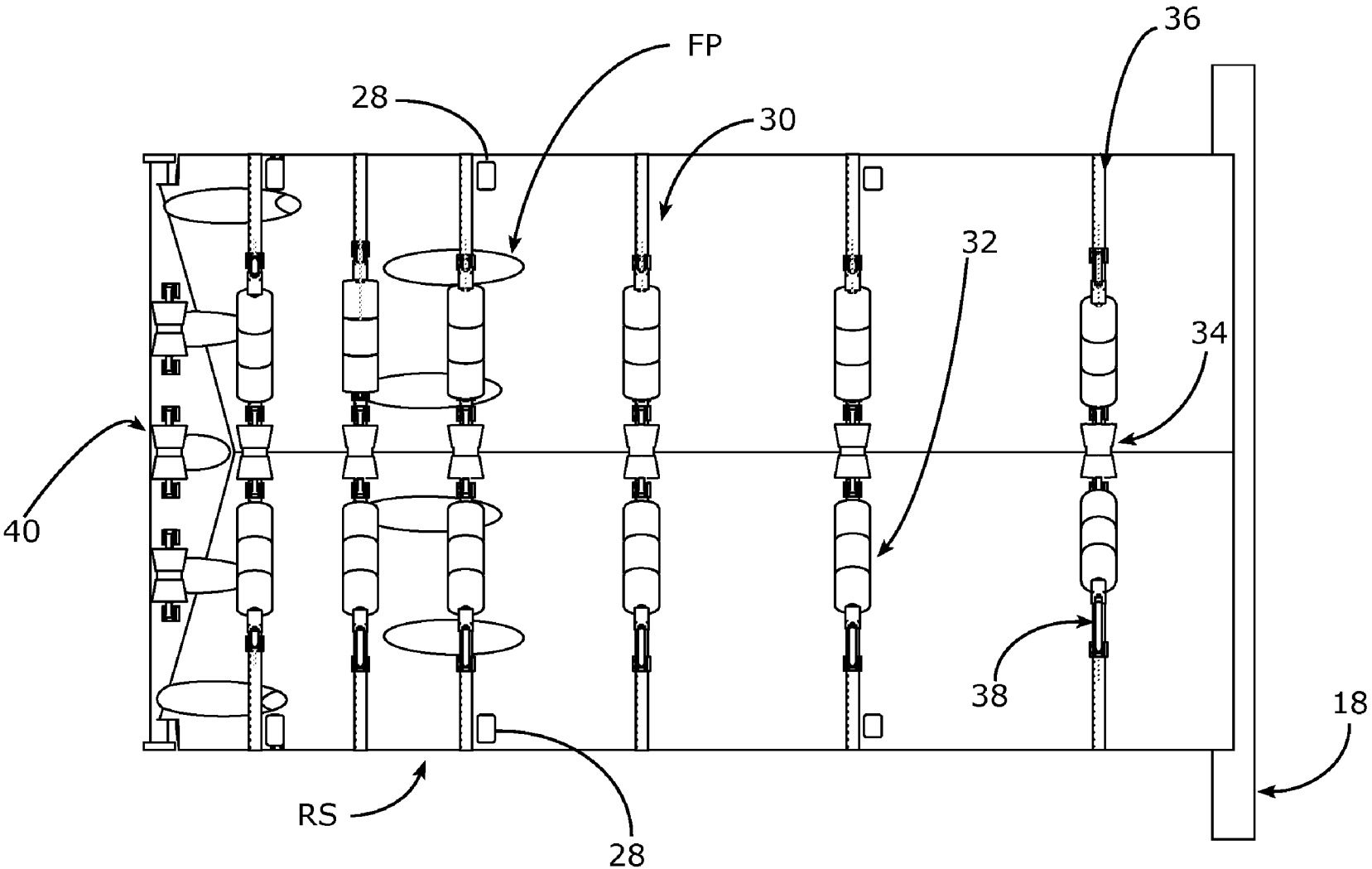
FIG. 10 is a top or plan view of the ramp structure shown in FIG. 9.
Figure 11:
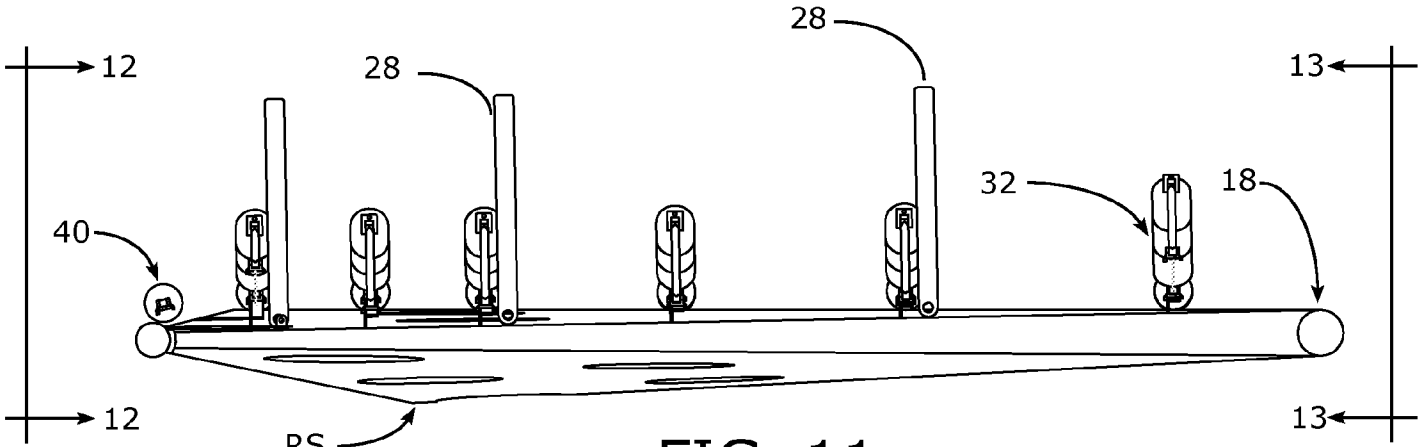
FIG. 11 is a side view of the ramp structure shown in FIG. 9.
Figure 12:
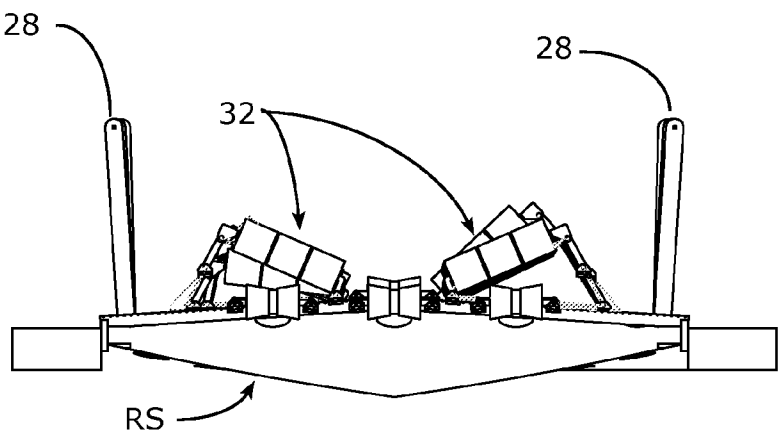
FIG. 12 is an end view of the ramp structure taken along line 12-12 of FIG. 11.
Figure 13:
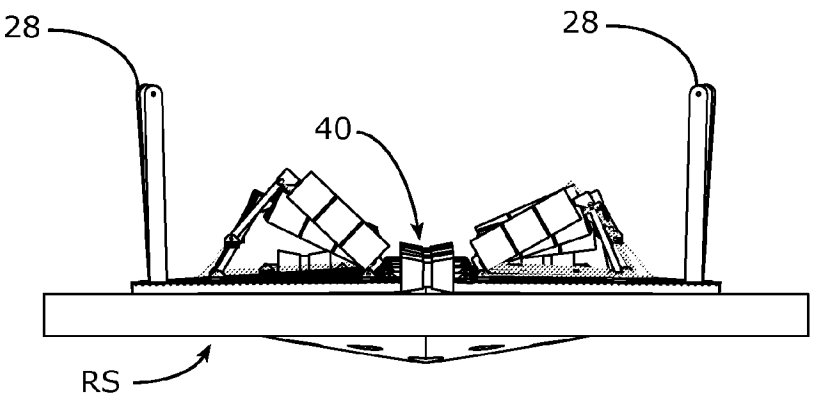
FIG. 13 is an end view of the ramp structure taken along line 13-13 of FIG. 11.

The above-described ramp structure RS is part of a larger sub-assembly for launching and recovering sub-ordinate vessels (as described in the above incorporated U.S. patent application 60/782,274 filed Mar. 15, 2006). As shown in FIGS. 9-13, the ramp structure RS is provided with lateral stanchions 28 and plural sets of rollers 30 appropriately placed and configured to accommodate the particular sub-ordinate vessel. In the case of FIGS. 8-9, six sets of rollers 30 are provided with each roller set 30 including oppositely inclined rollers 32 and keel rollers 34. The different sets of rollers 30 can be mounted on laterally aligned tracks 36 with the angle of inclination of the various rollers 32 controlled by adjustable links 38 to conform to or accommodate the particular shape of the sub-ordinate vessel or any associated structure being launched or recovered. In addition, other types of rollers 40 may be provided in accordance with the particular application.

Figure 14:
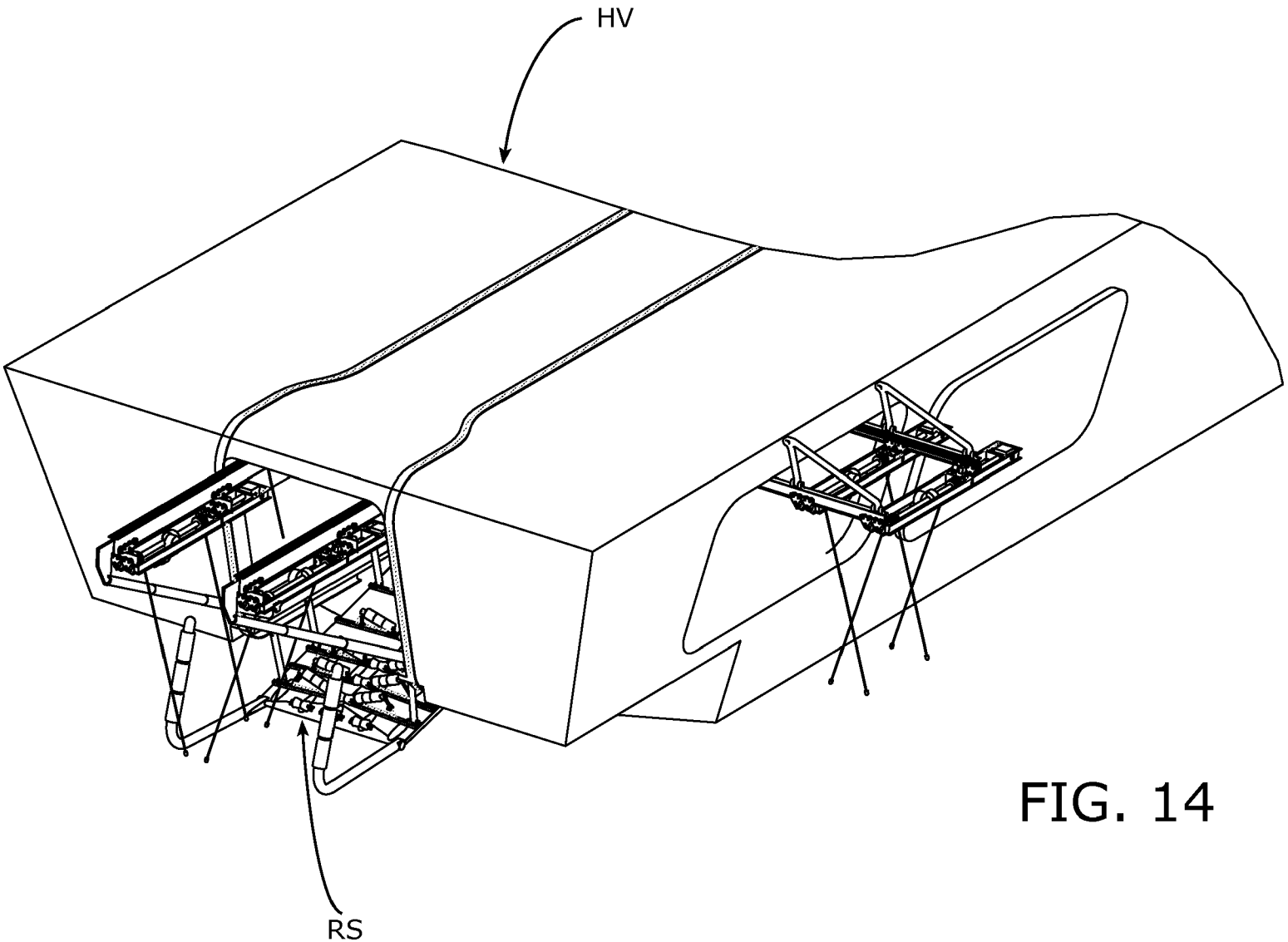
FIG. 14 is a perspective view of the ramp structure mounted on the stern of a host vessel in a representative application.
Figure 15:
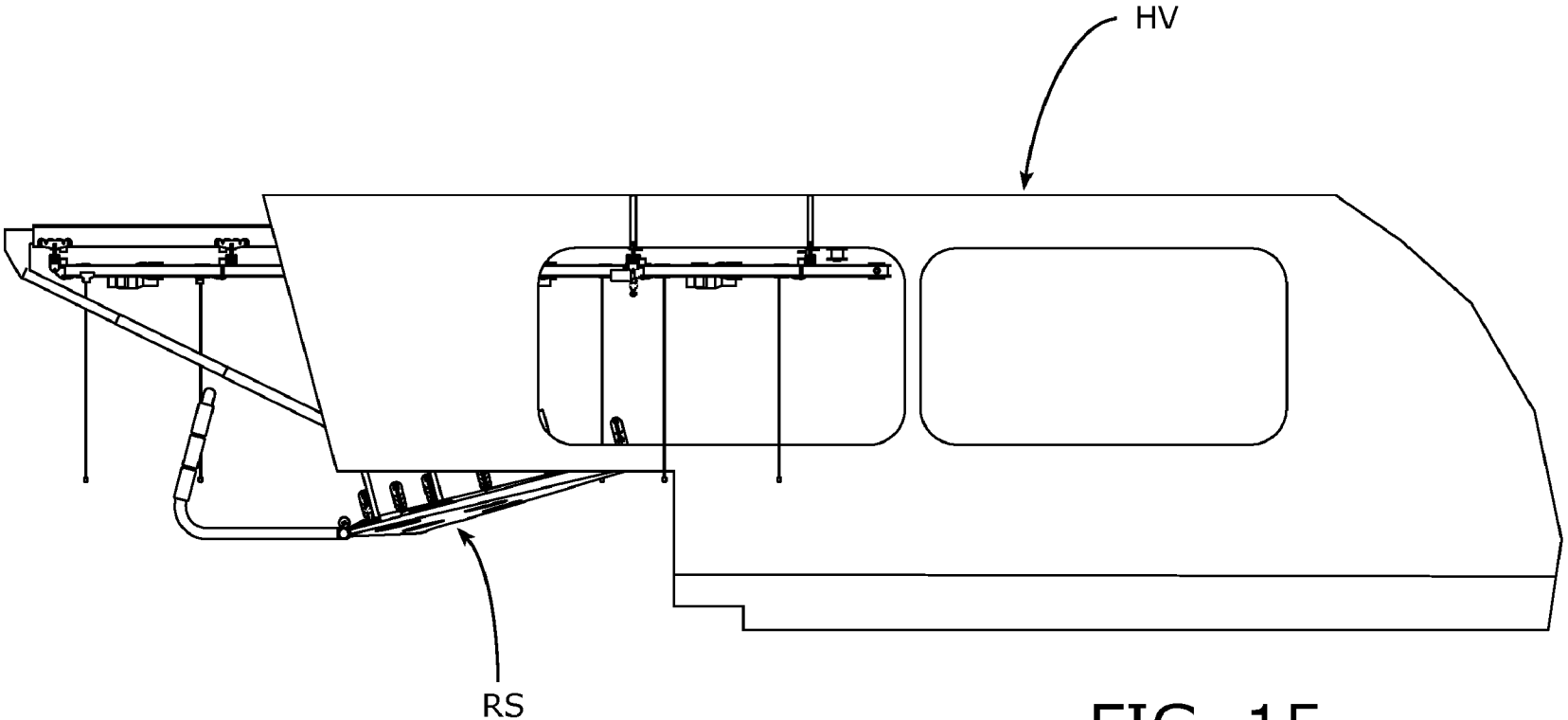
FIG. 15 is a side view of the host vessel and ramp structure shown in FIG. 14.

FIG. 14 is a perspective view and FIG. 15 side view of one possible application of the ramp structure RS; as shown, the ramp structure RS is located at the stern of a host vessel HV and cooperates with other structures, including a expandible/contractible flexible loop structure and a frame-like cradle described in the above incorporated patent application 60/782,274 filed Mar. 15, 2006 to launch and recover a sub-ordinate vessel.

In the description above, the attitude of the ramp structure can be controlled in a variety of ways including predetermined set points for the thru-flow ports, the quantity of water held in the ramp structure and/or the position of the plane 24. As can be appreciated, partial or full automatic control is possible to partly or fully compensate for the effects of wave and wind action by, for example, providing a shaft encoder attached to the shaft 18 to measure attitude relative to some reference and provide an output to a controller that controls the air flow through line 20 into the ramp structure RS to control buoyancy, the flow restriction devices (FIGS. 7*a*-7*e*) associated with the flow ports FP, and/or the adjustable plane 24 (FIG. 8) to drive the attitude of the ramp structure to the desired angle. In those cases where recovery or launch operations are taking place what the host is moving at some forward speed through waves, one or more sensors can be provided at a forward portion (i.e, the bow) of the host vessel to sense wave amplitude and periodicity to provide a measure of speed-dependant anticipatory control of the ramp structure RS at the aft portion of the host vessel.

As will be apparent to those skilled in the art, various changes and modifications may be made to the illustrated embodiment of the present invention without departing from the spirit and scope of the invention as determined in the appended claims and their legal equivalent.

The invention claimed is:

1. A ramp for the launching or recovery of a sub-ordinate vessel from a host watercraft vessel, comprising:

a ramp structure connected to a host vessel for relative movement therebetween and having an end thereof for at least partial submersion into the water; and at least one flow port in the ramp structure having an adjustable cross-section flow path therethrough extending from one side of the ramp to another side thereof located at or toward the submersible end of the ramp structure for controlling the angular relationship of the ramp structure relative to the host vessel as a function of the cross-section of the flow path therethrough and the flow of water therethrough from said one side of the ramp to said another side thereof.

2. The ramp of claim 1, wherein said ramp structure is mounted to its host watercraft vessel by a journalled connection.

3. The ramp of claim 1, further comprising a roller-equipped structure for contacting and supporting the hull of a sub-ordinate vessel.

4. The ramp of claim 1, further comprising a controllable flow plane for controlling the angular relationship of the ramp structure relative to the host vessel.

5. The ramp of claim 1, further comprising means for controlling the buoyancy of the submersible end of the ramp structure.

6. The ramp of claim 5, further comprising means for admitting water into or expressing water from the ramp structure to control the buoyancy of at least the submersible end of the ramp structure.

7. The ramp of claim 1, further comprising at least a moveable member associated with each flow port for controllably changing the cross-section of the flow path therethrough.

8. The ramp of claim 7, wherein said moveable member comprises at least one moveably mounted plate for controlled movement into and out of the flow cross-section to controllably change the cross-section of the flow path therethrough.

9. A system for the launching or recovery a sub-ordinate vessel from a host watercraft vessel, comprising:

a host watercraft vessel;

a ramp structure moveable connected to the host watercraft vessel for relative movement therebetween and having an end thereof for submersion into the water; and at least one flow port in the ramp structure having an adjustable cross-section flow path therethrough extending from one side of the ramp to another side thereof located at or toward the submersible end of the ramp structure for controlling the angular relationship of the ramp structure relative to the host vessel as a function of the cross-section of the flow path therethrough and the flow of water therethrough from said one side of the ramp to said another side thereof.

10. The system of claim 9, wherein said ramp structure is mounted to its host watercraft vessel by a journalled connection.

11. The system of claim 9, further comprising a roller-equipped structure for contacting and supporting the hull of a sub-ordinate vessel.

12. The system of claim 9, further comprising a controllable flow plane for controlling the angular relationship of the ramp structure relative to the host vessel.

13. The system of claim 9, further comprising means for controlling the buoyancy of the submersible end of the ramp structure.

14. The system of claim 13, further comprising means for admitting water into or expressing water from the ramp structure to control the buoyancy of at least the submersible end of the ramp structure.

15. The system of claim 9, further comprising at least a moveable member associated with each flow port for controllably changing the cross-section of the flow path therethrough.

16. The system of claim 15, wherein said moveable member comprises at least one moveably mounted plate for controlled movement into and out of the flow cross-section to controllably change the cross-section of the flow path therethrough.

* * * * *